US008977441B2

(12) United States Patent
Grimes et al.

(10) Patent No.: US 8,977,441 B2
(45) Date of Patent: Mar. 10, 2015

(54) METHOD AND SYSTEM FOR CALCULATING AND DISPLAYING WORK TOOL ORIENTATION AND MACHINE USING SAME

(75) Inventors: Joel R. Grimes, Fuquay-Varina, NC (US); Joseph Edward Forcash, Raleigh, NC (US); Christopher Lee Mays, Raleigh, NC (US); Steven Conrad Budde, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 912 days.

(21) Appl. No.: 13/170,849

(22) Filed: Jun. 28, 2011

(65) Prior Publication Data

US 2013/0004282 A1 Jan. 3, 2013

(51) Int. Cl.

| | |
|---|---|
| ***G06G 7/00*** | (2006.01) |
| ***E02F 3/96*** | (2006.01) |
| ***E02F 9/26*** | (2006.01) |
| ***B66F 9/065*** | (2006.01) |
| ***B66F 9/075*** | (2006.01) |

(52) U.S. Cl.

CPC . *E02F 3/96* (2013.01); *E02F 9/264* (2013.01); *B66F 9/065* (2013.01); *B66F 9/0755* (2013.01)

USPC ..... 701/50; 701/1; 701/16; 297/172; 296/193.04; 414/723; 404/86; 404/94; 434/29; 111/118; 172/1; 37/357

(58) Field of Classification Search

USPC ..... 701/1, 16; 297/172; 296/193.04; 414/723; 404/86, 94; 434/29; 111/118; 172/1; 37/357

See application file for complete search history.

(56) References Cited

U.S. PATENT DOCUMENTS

| | | | | |
|---|---|---|---|---|
| 5,052,883 | A | 10/1991 | Morita et al. | |
| 6,766,600 | B2 | 7/2004 | Ogura et al. | |
| 6,826,465 | B2 | 11/2004 | Ishimoto et al. | |
| 2001/0015567 | A1 * | 8/2001 | Tholkes et al. | 297/172 |
| 2001/0053323 | A1 * | 12/2001 | Godwin et al. | 414/723 |
| 2002/0167205 | A1 * | 11/2002 | Tholkes et al. | 297/172 |
| 2003/0035687 | A1 * | 2/2003 | Gray | 404/94 |
| 2003/0093187 | A1 * | 5/2003 | Walker | 701/1 |
| 2005/0045080 | A1 * | 3/2005 | Halford et al. | 111/118 |
| 2005/0187677 | A1 * | 8/2005 | Walker | 701/16 |
| 2009/0140550 | A1 * | 6/2009 | Gerke | 296/193.04 |
| 2009/0232598 | A1 * | 9/2009 | Cochran et al. | 404/86 |
| 2010/0184005 | A1 * | 7/2010 | Eklund et al. | 434/29 |
| 2011/0061880 | A1 * | 3/2011 | De Bree | 172/1 |
| 2011/0308116 | A1 * | 12/2011 | Peterson | 37/357 |

FOREIGN PATENT DOCUMENTS

JP 2001159156 6/2001

* cited by examiner

*Primary Examiner* — James Trammell
*Assistant Examiner* — Sanjeev Malhotra
(74) *Attorney, Agent, or Firm* — Liell & McNeil Attorneys, PC

(57) ABSTRACT

A machine includes a plurality of ground engaging elements and an operator control station supported on a frame. A work tool is pivotably attached to the frame using a lift arm assembly and a tilt linkage. At least one device measures a quantity associated with at least one of the lift arm assembly, the tilt linkage, and the work tool. An electronic controller, in communication with an operator display and the at least one device. The electronic controller is configured to store an operator selected orientation of the work tool, calculate a current orientation of the work tool based on the quantity, and calculate a deviation of the current orientation from the operator selected orientation. A visual representation of the deviation is displayed on the operator display.

20 Claims, 3 Drawing Sheets

METHOD AND SYSTEM FOR CALCULATING AND DISPLAYING WORK TOOL ORIENTATION AND MACHINE USING SAME

TECHNICAL FIELD

The present disclosure relates generally to calculating a current work tool orientation, and more particularly to displaying a deviation of the current work tool orientation from an operator selected orientation of the work tool.

BACKGROUND

Machines may be equipped with a variety of work tools, such as, for example, buckets, blades, forks, and the like, for performing work operations, such as material handling operations. Typically, the work tool is attached to the machine using an implement assembly. For example, the implement assembly may include a lift arm assembly for raising and lowering the work tool, and a tilt linkage for pivoting the work tool relative to the machine. In some instances, the implement assembly may include a coupler, or similar mechanism, for facilitating attachment of the implement assembly to a variety of interchangeable work tools. Thus, the machine may be more readily attached to the appropriate work tool as dictated by the current operation.

Typical work operations require the positioning and repositioning of the work tool using one or more controllers, such as a lift adjustment controller and a tilt adjustment controller, positioned within an operator control station of the machine. Such work operations may require precise positioning of the work tool, which may require a relatively high degree of operator skill. Further, according to some implement assemblies, one or more components of the lift arm assembly and/or the tilt linkage may interfere with the line of sight of the operator. Thus, manipulation of the controllers to move the work tool, particularly according to repeated work cycles, may prove difficult and tedious, contributing to operator fatigue and diminished work efficiency.

U.S. Pat. No. 6,766,600 to Ogura et al. teaches a display for a construction machine that allows an operator to set a target plane for a work operation to be performed under automatic control. More specifically, the operator may select a gradient of the target plane and the plane may be displayed at an angle corresponding to the selected gradient. A bucket symbol corresponding to a bucket angle, which is calculated by a control unit using a bucket angle sensor, is also displayed. The bucket symbol is rotatable depending on the current angle of the bucket. By displaying both the target gradient and the bucket angle, an operator may view the relative difference between the two angles.

The present disclosure is directed to one or more of the problems set forth above.

SUMMARY OF THE DISCLOSURE

In one aspect, a machine includes a plurality of ground engaging elements and an operator control station supported on a frame. A work tool is pivotably attached to the frame using a lift arm assembly and a tilt linkage. At least one device measures a quantity associated with at least one of the lift arm assembly, the tilt linkage, and the work tool. An electronic controller, in communication with an operator display and the at least one device, is configured to store an operator selected orientation of the work tool, calculate a current orientation of the work tool based at least in part on the quantity, and calculate a deviation of the current orientation from the operator selected orientation. A visual representation of the deviation is displayed on the operator display.

In another aspect, a method of operating a machine includes a step of storing an operator selected orientation of a work tool on an electronic controller. A current orientation of the work tool is calculated based at least in part on a measured quantity associated with at least one of a lift arm assembly, a tilt linkage, and the work tool using the electronic controller. A deviation of the current orientation from the operator selected orientation is calculated using the electronic controller, and a visual representation of the deviation is displayed on an operator display.

In yet another aspect, a control system for a machine includes an electronic controller including a memory having a work tool positioning display algorithm and an operator selected orientation stored thereon. The electronic controller includes a processor configured to execute the work tool positioning display algorithm. The work tool positioning display algorithm is configured to receive a device signal corresponding to a measured quantity associated with at least one of a lift arm assembly, a tilt linkage, and the work tool. The work tool positioning display algorithm is further configured to calculate a current orientation of the work tool based at least in part on the measured quantity, calculate a deviation of the current orientation from the operator selected orientation, and send a first display signal corresponding to the deviation to an operator display.

DETAILED DESCRIPTION

Figure 1:
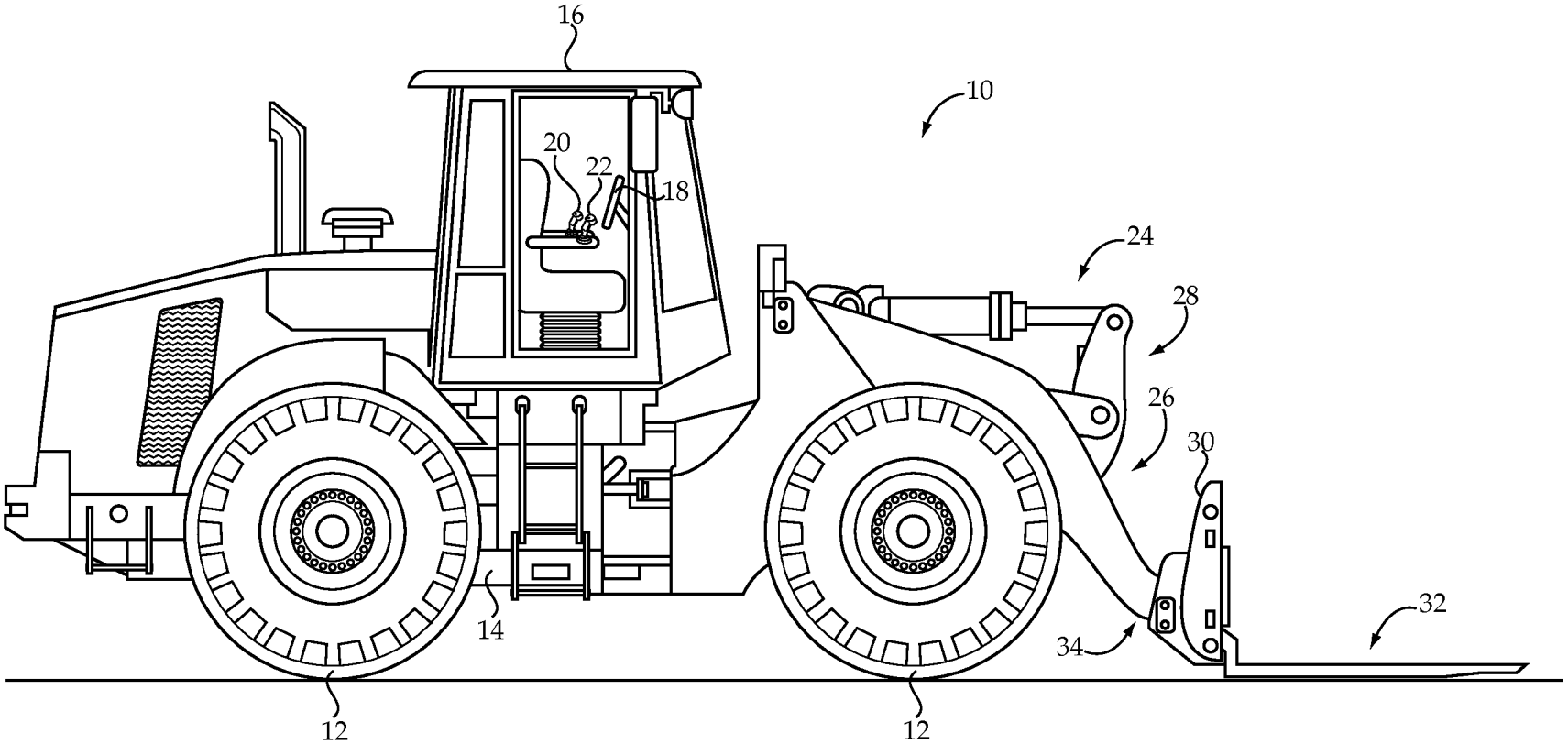
FIG. 1 is a side diagrammatic view of a machine having a system for calculating and displaying work tool orientation, according to the present disclosure.

An exemplary embodiment of a machine 10 is shown generally in FIG. 1. The machine 10 may be an off-highway machine, such as, for example, a wheel loader, or any other machine having a plurality of ground engaging elements, such as wheels 12, supported on a frame 14. Although wheels are shown, the present disclosure is equally applicable to machines having other ground engaging means, such as, for example, a tracked undercarriage. The machine 10 also includes an operator control station 16 supported on the frame 14 and may house an operator display 18 for displaying various operational information relating to the machine 10. A lift adjustment controller 20 and a tilt adjustment controller 22 may also be positioned within the operator control station 16 for controlling an implement assembly 24 of the machine 10.

The implement assembly 24 generally comprises a lift arm assembly 26, a tilt linkage 28, and a work tool 30. Although a pair of forks 32 is shown, it should be appreciated that the machine 10 may support any of a variety of different work tools, including, for example, a bucket or blade. According to some embodiments, the machine 10 may include a coupler 34, or other similar mechanism, which provides a means for coupling a variety of interchangeable work tools, such as work tool 30, to the machine 10. The lift arm assembly 26 may be pivotably attached to the frame 14, while the tilt linkage 28 may be pivotably attached to the lift arm assembly 26. Although alternative configurations are applicable to the present disclosure, a specific embodiment of an implement assembly 24 is provided herein for exemplary purposes.

Figure 2:
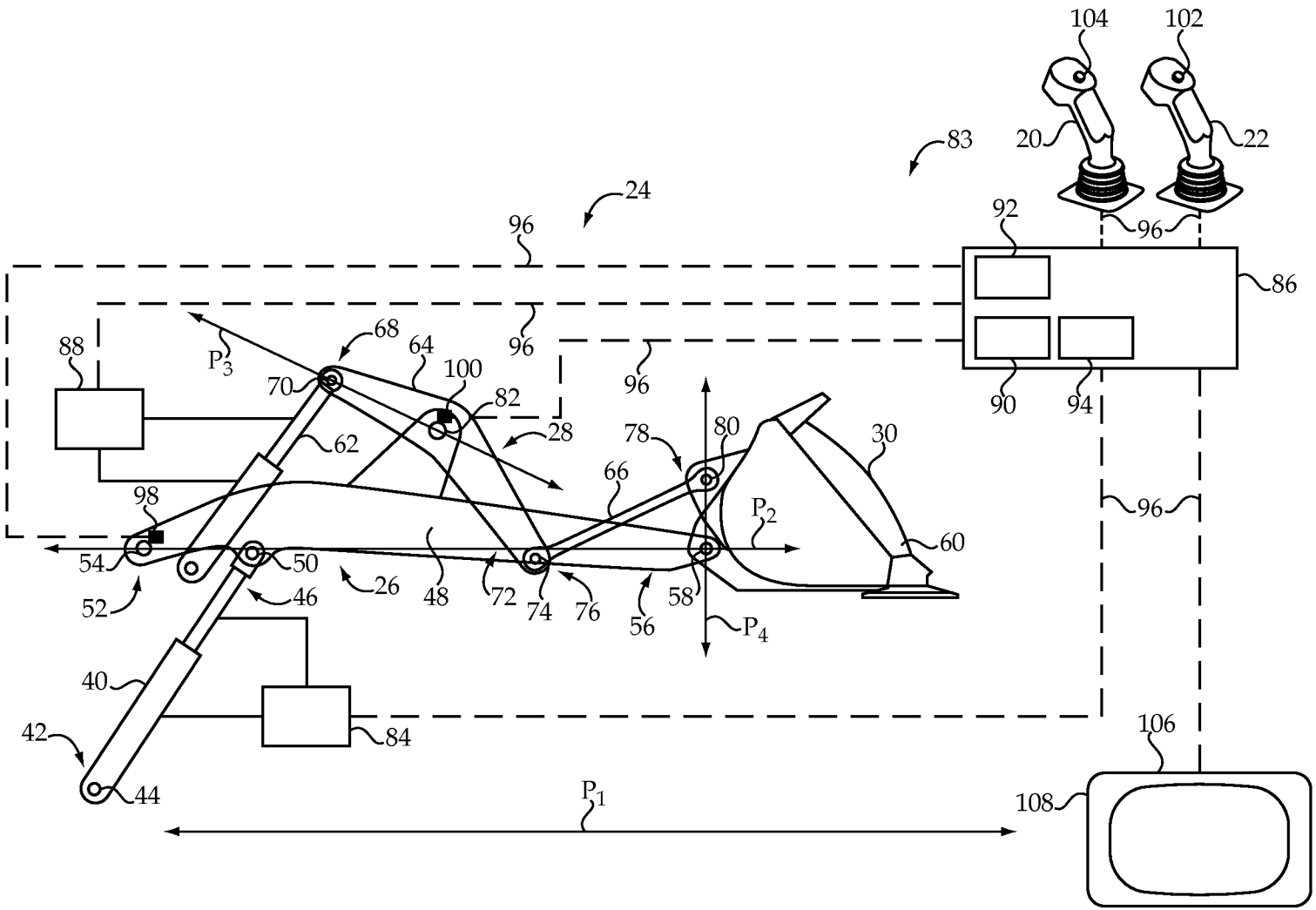
FIG. 2 is a side diagrammatic view of the implement assembly of FIG. 1, and an exemplary control system for calculating and displaying work tool orientation, according to one aspect of the present disclosure.

Turning now to FIG. 2, but referring also to FIG. 1, the lift arm assembly 26 includes a pair of hydraulic lift cylinders 40 (only one of which is shown) having first ends 42 pivotably attached to the frame 14 at first lift cylinder pivot points 44 and second ends 46 pivotably attached to lift arms 48 at second lift cylinder pivot points 50. The lift arms 48 have first ends 52 pivotably attached to the frame 14 at first lift arm pivot points 54 and second ends 56 to which the work tool 30 is pivotably attached at first work tool pivot points 58. According to the exemplary embodiment of FIG. 2, the work tool 30 is exemplified as a bucket 60. However, it should be appreciated that alternative work tools, such as the forks 32 of FIG. 1, may be substituted for the bucket 60.

The work tool 30 is pivotably mounted to the lift arms 48 at the first work tool pivot points 58 and is pivotably connected to a hydraulic tilt cylinder 62 via the tilt linkage 28. The tilt linkage 28 includes a first link member 64 and a second link member 66. Although not shown, it should be appreciated that the tilt linkage 28 may include a pair of first link members 64 and a pair of second link members 66, according to alternative configurations. A first end 68 of the first link member 64 is pivotably attached to the hydraulic tilt cylinder 62 at first link member pivot points 70, and a second end 72 is pivotably attached to the lift arms 48 at second link member pivot points 74. The second link member 66 has a first end 76 pivotably attached to the lift arms 48 at the pivot points 74 and a second end 78 pivotably attached to the work tool 30 at second work tool pivot points 80. As the hydraulic tilt cylinder 62 is actuated, the first link members pivot about frame supported pivot points 82.

The hydraulic lift and tilt cylinders 40 and 62 are extendable and retractable in response to movement of the lift adjustment controller 20 and tilt adjustment controller 22, introduced above, using a control system 83. Generally speaking, for example, the hydraulic lift cylinders 40 are positioned to adjust the angular orientation of the lift arm assembly 26 responsive to movement of the lift adjustment controller 20. More specifically, as the hydraulic lift cylinders 40 extend and retract, the lift arms 48 may be pivoted relative to the frame 14 at the first lift arm pivot points 54, thus raising and lowering the work tool 30. The hydraulic tilt cylinder 62 is positioned to adjust the angular orientation of the tilt linkage 28 in response to movement of the tilt adjustment controller 22. More specifically, as the hydraulic tilt cylinder 62 extends and retracts, the work tool 30 is pivoted toward the machine 10 and pivoted away from the machine 10 using the tilt linkage 28.

The movements of the implement assembly 24, as described above, may be carried out using an electro-hydraulic system, as is known in the art. For example, according to the exemplary embodiment, the actuation of the lift arm assembly 26 may be carried out using a first electro-hydraulic circuit, shown generally at 84, hydraulically coupled to the hydraulic lift cylinders 40. Electro-hydraulic circuits are known and generally include a fluid reservoir, pump, electronically actuated valve, filters, and the like for controlling a hydraulic fluid along the hydraulic circuit. Specifically, an electronic controller 86 may communicate with the electro-hydraulic circuit 84, or an electronically actuated valve thereof, to control the flow of hydraulic fluid to and from the hydraulic lift cylinders 40 via the electro-hydraulic circuit 84.

The operator may control the movement of the lift arm assembly 26 by manipulating the lift adjustment controller 20. Specifically, for example, the lift adjustment controller 20 may be configured to generate a first lift control signal in proportion to a degree of manipulation in a particular direction of the lift adjustment controller 20 by the operator, the first lift control signal being proportional to a desired lift arm assembly movement. The electronic controller 86, in communication with the lift adjustment controller 20 and hydraulic lift cylinders 40, receives the first lift control signal and responds by generating a second lift control signal proportional to the first lift control signal, which is received by the electro-hydraulic circuit 84. The electro-hydraulic circuit 84 responds to the second lift control signal by directing hydraulic fluid to and from the hydraulic lift cylinders 40 at a rate proportional to the second lift control signal, causing the hydraulic lift cylinders 40 to move the lift arms 48 about the pivot points 54 accordingly.

Actuation of the tilt linkage 28 may also be carried out using an electro-hydraulic circuit, such as a second electro-hydraulic circuit 88, hydraulically coupled to the hydraulic tilt cylinder 62. Specifically, for example, the tilt adjustment controller 22 may be configured to generate a first tilt control signal in proportion to a degree of manipulation by the operator and proportional to a desired movement of the work tool 30. The electronic controller 86, in communication with the tilt adjustment controller 22 and hydraulic tilt cylinder 62, receives the first tilt control signal and responds by generating a second tilt control signal proportional to the first tilt control signal, which is received by the electro-hydraulic circuit 88. The electro-hydraulic circuit 88 responds to the second tilt control signal by directing hydraulic fluid to and from the hydraulic tilt cylinder 62, causing the hydraulic tilt cylinder 62 to extend and retract and, thus, pivot the work tool 30.

The electronic controller 86 may be of standard design and may include a processor 90, such as, for example, a central processing unit, a memory 92, and an input/output circuit 94 that facilitates communication internal and external to the electronic controller 86. The processor 90, for example, may control operation of the electronic controller 86 by executing operating instructions, such as, for example, computer readable program code stored in the memory 92, wherein operations may be initiated internally or externally to the electronic controller 86. Control schemes may be utilized that monitor outputs of systems or devices, such as, for example, sensors, actuators, or control units, via the input/output circuit 94 to control inputs to various other systems or devices. The memory 92, as used herein, may comprise temporary storage areas, such as, for example, cache, virtual memory, or random access memory, or permanent storage areas, such as, for example, read-only memory, removable drives, network/internet storage, hard drives, flash memory, memory sticks, or any other known volatile or non-volatile data storage devices. One skilled in the art will appreciate that any computer based system or device utilizing similar components for controlling the machine systems or components described herein, is suitable for use with the present disclosure.

The electronic controller 86 may communicate with various systems and components of the machine 10 via one or more wired and/or wireless communications lines 96, or other similar communication circuits. For example, regarding the control system 83, the electronic controller 86 may communicate with the lift and tilt adjustment controllers 20 and 22, the electro-hydraulic circuits 84 and 88, and various additional components of the machine 10 via communications lines 96 to affect a control scheme described herein. More specifically, for example, the electronic controller 86 may also communicate with first and second sensors 98 and 100 via communications lines 96. According to the exemplary embodiment, the first and second sensors 98 and 100 may be rotary sensors for monitoring the angular displacement of particular linkage points, or pivot points, of the implement assembly 24.

Rotary sensors, such as first and second sensors 98 and 100, are known and may function by having a first portion attached to a linkage pin, such as a linkage pin defining one of the pivot points described above, and a second portion attached to a housing surrounding the linkage pin. As the linkage pin rotates relative to the housing, the rotary sensor senses the amount of rotation and provides an electrical signal indicative of this rotation. According to a specific example, the first sensor 98 may be positioned at first lift arm pivot points 54 and may be configured to detect an angular displacement of the lift arms 48 relative to a reference plane $P_1$, such as, for example, the frame 14 or the ground. More specifically, the first sensor 98 may detect the angular displacement of a second plane $P_2$ intersecting pivot points 54 and 58 of the lift arms 48 relative to the reference plane $P_1$. The second sensor 100 may be positioned and configured to detect an angular displacement of the work tool 30 relative to the lift arms 48. More specifically, the second sensor 100 may detect the angular displacement of a third plane $P_3$ intersecting pivot points 70 and 82 of the first link member 64 relative to the second plane $P_2$.

The rotational values detected by the first and second sensors 98 and 100 may be used by the electronic controller 86 to calculate, or otherwise determine, various information pertaining to the implement assembly 24, including lengths of the hydraulic cylinders 40 and 62. For example, the angular displacement of the lift arms 48, or second plane $P_2$, relative to the reference plane $P_1$ may provide a lift arm angle. The lift arm angle may be correlated to a length of the hydraulic lift cylinders 40 in an informational table stored in memory 92. The length of the hydraulic lift cylinders 40 may, in turn, be correlated to a height of a specific reference point of the work tool 30. For example, the cylinder length may be correlated to a height of one of pivot points 58 and 80 relative to the frame 14 or the ground. As such, the angular displacement detected by the first sensor 98, along with informational data stored in memory 92, may be used to determine a current height associated with the work tool 30.

The angular displacement of the first link member 64 or, more specifically, the third plane $P_3$ relative to the second plane $P_2$ may provide a first link member angle. The first link member angle may be correlated to an angle of the work tool 30 relative to the lift arms 48, or the second plane $P_2$, in another informational table stored in memory 92. The work tool angle may represent the angle of a fourth plane $P_4$ intersecting pivot points 58 and 80 relative to the lift arms 48, or the second plane $P_2$. The work tool angle may be used in additional calculations, as will be described below, and may be correlated to a length of the hydraulic tilt cylinder 62 in another informational table stored in the memory 92. As should be appreciated, alternative sensors may be used and, further, the sensors may be positioned in alternative locations. Such changes, as should be appreciated, may affect the correlation data stored in memory 92. Such correlation data may be provided by the manufacturer and/or may be determined using various measurements and/or equations, as should be appreciated by those skilled in the art.

The control system 83 may also allow an operator to select and store one or more operator selected positions. Specifically, for example, the electronic controller 86 may store an operator selected orientation corresponding to an operator selected angular displacement of the work tool 30 relative to the reference plane $P_1$. The operator selected orientation, which may also be referred to as a kickout, return-to-dig, or automatic bucket leveler feature by those skilled in the art, may be based on operator selected positions of the lift adjustment controller 20 and tilt adjustment controller 22, and may be selected using an orientation selector 102. For example, the orientation selector 102 may be a push-button switch or other appropriate device, which may or may not be integrated with the tilt adjustment controller 22, for producing an orientation signal corresponding to the operator selected orientation. In response to receiving the orientation signal, the electronic controller 86 may store the operator selected orientation in memory 92.

According to a specific example, the electronic controller 86, in response to receiving the orientation signal, may determine the current orientation of the work tool 30 using the first and second sensors 98 and 100, as described above. The electronic controller 86 may then store in memory 92 information indicative of the operator selected orientation. For example, the electronic controller 86 may store angular displacements as detected by the first and second sensors 98 and 100 or, alternatively, may store cylinder lengths corresponding to the hydraulic lift cylinder 40 and the hydraulic tilt cylinder 62. The electronic controller 86 may be further configured to store a default orientation, which may correspond to a manufacturer selected default value, of the work tool 30 in memory 92.

The electronic controller 86 may also store first and second operator selected heights corresponding to an operator selected angular displacement of the lift arms 48, or second plane $P_2$, relative to the reference plane $P_1$. As described above, this angular displacement may be correlated to a height of the work tool 30. The operator selected heights may be based on operator selected positions of the lift adjustment controller 20 and may be selected using a height selector 104. The height selector 104, similar to the orientation selector 102, may be a push-button switch or other appropriate device, which may or may not be integrated with the lift adjustment controller 20, for producing one or more height selection signal(s) corresponding to the operator selected height(s). In response to receiving the height selection signal(s), the electronic controller 86 may store the operator selected height(s) in memory 92. The electronic controller 86 may be further configured to store one or more default heights, which may correspond to manufacturer selected default values, of the work tool 30.

The memory 92 may also store a work tool positioning display algorithm, along with the operator selected orientation and the one or more operator selected heights. The processor 90 may be configured to execute the work tool positioning display algorithm, which includes receiving a first angular orientation signal from the first sensor 98, which corresponds to an angular orientation of the lift arm assembly 26, and a second angular orientation signal from the second sensor 100, which corresponds to an angular orientation of the tilt linkage 28. Specifically, as described above, the first sensor 98 may be configured to detect an angular displacement of the lift arm 48 relative to the reference plane $P_1$, and the second sensor 100 may be configured to detect an angular displacement of the work tool 30 relative to the lift arm 48.

A current orientation of the work tool 30 may then be calculated based on the angular orientations determined above. Specifically, the current orientation may be calculated by adding the lift arm angle, which is the angular displacement of the lift arms 48, or second plane $P_2$, relative to the reference plane $P_1$ as detected by the sensor 98, and the work tool angle, which is the angle of a fourth plane $P_4$ intersecting pivot points 58 and 80 relative to the lift arms 48, or the second plane $P_2$. As stated above, the work tool angle is selected from memory 92 and is correlated to the first link member angle, which is the angular displacement of the first link member 64 or, more specifically, the third plane $P_3$ relative to the second plane $P_2$ as detected by second sensor 100. The lift arm angle and the work tool angle may be added together to arrive at the current orientation of the work tool 30 relative to the reference plane $P_1$.

According to the work tool positioning display algorithm, the electronic controller 86 may also calculate a deviation of the current orientation of the work tool 30 from the operator selected orientation. Specifically, the electronic controller 86 may subtract the operator selected orientation from the current orientation to arrive at the deviation. The deviation may represent a difference, in degrees of angular displacement, of the current orientation relative to the operator selected orientation. Alternatively, if an operator selected orientation is not stored in memory 92, the deviation may represent a difference of the current orientation relative to the default orientation. The electronic controller 86, after performing the steps of the work tool positioning display algorithm described above, may then send a first display signal corresponding to the deviation to an operator display 106. As will be discussed below, a visual representation of the deviation may be displayed on the operator display 106 or, more particularly, a display screen 108 of the operator display 106.

The work tool positioning display algorithm may also include a calculation of a current height of the work tool 30 based on the angular orientation of the lift arm assembly 26. As described above, for example, the angular displacement of the lift arms 48, or second plane $P_2$, relative to the reference plane $P_1$, as detected by the first sensor 98, may provide a lift arm angle. The lift arm angle may be correlated to a length of the hydraulic lift cylinders 40 in an informational table stored in memory 92. The length of the hydraulic lift cylinders 40 may, in turn, be correlated to a height of a specific reference point of the work tool 30. As such, the angular displacement detected by the first sensor, along with informational data stored in memory 92, may be used to determine the current height of the work tool 30.

The electronic controller 86, in accordance with the work tool positioning display algorithm, may also be configured to calculate a deviation of the current height of the work tool 30 from an operator selected height, or default height, stored in memory 92. Specifically, the electronic controller 86 may subtract the operator selected height, or default height, from the current height to arrive at the deviation. The electronic controller 86 may send a second display signal corresponding to the deviation to the operator display 106. As described above, a visual representation of the deviation may be displayed on the operator display 106 in response to the second display signal. Alternatively, for example, it may be desirable to display a visual representation of the current height relative to one or more operator selected heights.

Although the exemplary embodiment teaches the use of rotary sensors 98 and 100 for determining the current orientation of the work tool 30, it should be appreciated that the present disclosure has wider applicability. Specifically, the machine 10 may include any of a number of devices for measuring a quantity associated with at least one of the lift arm assembly 26, the tilt linkage 28, and the work tool 30, and transmitting a device signal corresponding to the quantity to the electronic controller 86. The current orientation of the work tool 30 is then calculated based at least in part on the quantity. For example, the machine 10 may include sensors for detecting the length of one or more of the hydraulic lift cylinders 40 and the hydraulic tilt cylinder 62. The cylinder lengths may then be used, in a known fashion, to calculate the current work tool orientation. According to another example, the machine 10 may include one or more inclinometers for detecting an angular rotation of the work tool 30. These one or more quantities may then be used by the electronic controller 86 to calculate the work tool orientation.

Figure 3:
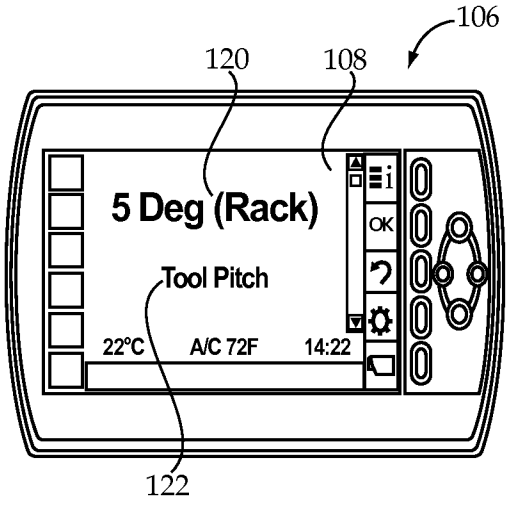
FIG. 3 is an illustration of an exemplary display screen of an operator display of the machine of FIG. 1, according to another aspect of the present disclosure.

Turning now to FIG. 3, an exemplary embodiment of the operator display 106 is illustrated. The operator display 106 may correspond to the operator display 18 of FIG. 1, positioned within the operator control station 16, or may be an additional, or alternative, operator display positioned within the operator control station 16 or elsewhere, such as at a location remote from the machine 10. According to one example, the operator display 106 may be a secondary operator display, while the operator display 18 of FIG. 1 may be a primary operator display. As should be appreciated, a primary operator display may display information that is more frequently observed by the operator, such as machine speed, engine speed, fuel level, temperatures, etc., while the secondary operator display may display information that is not referenced as often as the information of the primary operator display. Further, it may be desirable to configure the operator display 106 such that the operator may select which one or more screens, or pieces of information, are displayed. For example, the operator may only wish to display the work tool orientation information described herein when performing a particular work operation.

According to the exemplary operator display 106 of FIG. 3, the display screen 108 may depict a digital readout 120 corresponding to a deviation of the current work tool orientation from the operator selected orientation. For example, the operator selected orientation may correspond to 0 degrees, which may represent an orientation of the work tool 30 that is substantially level, or parallel, with respect to the frame 14 or the ground. According to this example, the deviation may represent a number of degrees of deviation of the current orientation relative to 0 degrees. So, if the current orientation is −5 degrees, the deviation is −5 degrees minus 0 degrees, which is −5 degrees. It should be appreciated that "rack" may represent an orientation pivoted toward the machine, while "dump" may represent an orientation pivoted away from the machine. The display screen 108 may also depict a description 122, such as "Tool Pitch," which provides the operator with an indication of the particular information being displayed. Thus, for example, when the operator views the operator display 108 of FIG. 3, the operator can easily be advised that the current pitch, also referred to as angular orientation, of the work tool 30 relative to the operator selected orientation is −5 degrees, or pivoted 5 degrees toward the machine 10.

Figure 4:
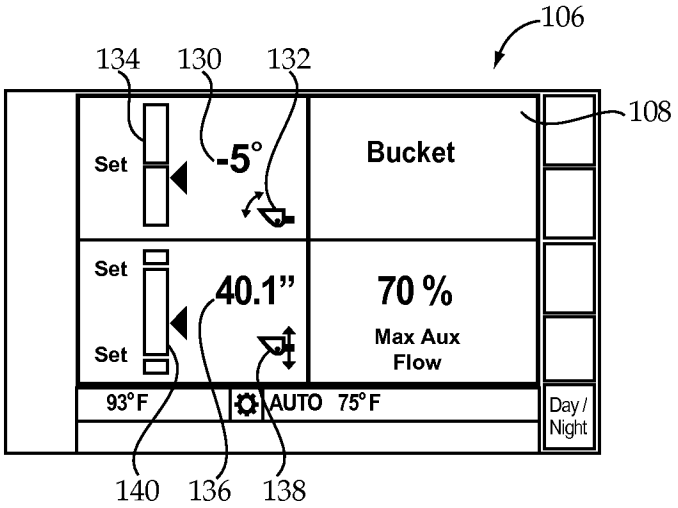
FIG. 4 is an illustration of another exemplary display screen of an operator display of the machine of FIG. 1, according to another aspect of the present disclosure.

Turning now to FIG. 4, an alternative illustration is depicted on the display screen 108 of the operator display 106. Specifically, the −5 degrees deviation of the work tool orientation relative to the operator selected orientation may be illustrated using a digital readout 130, which may be similar to the digital readout 120 of FIG. 3, and may be further illustrated by depicting a work tool symbol 132 having an arrow indicating the information being conveyed. For example, the arrow of work tool symbol 132 may visually reference the angular movement of the work tool 30. The operator display 106 may also depict a relational symbol 134 illustrating the deviation of the current orientation, depicted using an arrow, relative to the operator selected orientation, depicted using a bar having a line corresponding to the set point. Thus, the operator can look to the operator display 106 of FIG. 4 to ascertain that the current angular orientation of the work tool is −5 degrees, which is below, or less than, the operator selected setting, by 5 degrees.

The operator display 106 may also depict a digital readout 136 corresponding to the current height of the work tool 30, such as in inches. The current height may be further illustrated by depicting a work tool symbol 138 having an arrow indicating the information being conveyed. For example, the arrow of work tool symbol 138 may visually reference the vertical movement, or height, of the work tool 30. The operator display 106 may also depict a relational symbol 140 illustrating the current height, depicted using an arrow, relative to first and second operator selected heights, depicted using a bar having lines corresponding to the two operator selected heights. Thus, the operator can look to the operator display 106 of FIG. 4 to also ascertain that the current height of the work tool is 40.1 inches, which is closer to a lower operator selected height than an upper operator selected height.

As should be appreciated, the specific illustrations of FIGS. 3 and 4 are provided for exemplary purposes only. The information discussed above may be conveyed in any useful manner, which may include the depiction of any one or more letters, numbers, symbols, as well as graphics, animations, sounds, colors, and the like. According to a specific example, the illustration provided for the operator may be color coded, such that a deviation less than a predetermined deviation is displayed in green, while a deviation greater than the predetermined deviation is represented in red. A deviation range corresponding to the predetermined deviation may be displayed to the operator in yellow.

INDUSTRIAL APPLICABILITY

The present disclosure may be applicable to machines having work tools attached to the machine through an implement assembly, which may include a lift arm assembly and a tilt linkage. Further, the present disclosure may be applicable to such machines having an electronic control system, such as, for example, an electro-hydraulic system, for controlling movement of the implement assembly. Yet further, the present disclosure may be applicable to machines having electronically controlled implement assemblies and electronically stored operator selected orientations.

Referring to FIG. 1-4, a machine 10, such as a wheel loader, may include a plurality of ground engaging elements 12 supported on a frame 14. The machine 10 may also include an operator control station 16 supported on the frame 14 and housing one or more operator displays, such as operator display 18 and operator display 106. An implement assembly 24, supported on the frame 14, generally comprises a lift arm assembly 26, a tilt linkage 28, and a work tool 30. A lift adjustment controller 20 may be positioned within the operator control station 16 and used to control an angular orientation of the lift arm assembly 26 via an electro-hydraulic circuit 84, while a tilt adjustment controller 22, also positioned within the operator control station 16, may be used to control an angular orientation of the tilt linkage 28 using another electro-hydraulic circuit 88. First and second sensors 98 and 100, which may be rotary sensors as described above, may be positioned to detect angular orientations of the lift arm assembly 26 and the tilt linkage 28, respectively.

To operate the machine 10, an operator may move the lift adjustment controller 20 to raise or lower the work tool 30, and may move the tilt adjustment controller 22 to adjust the angular orientation, or pitch, of the work tool 30, as described above. If desired, the operator may use a control system 83 to select and store an operator selected orientation and one or more operator selected heights of the work tool. The operator selected orientation and operator selected heights, which may be selected and stored as described above, may correspond to particular work tool positions to which the operator may wish to return. For example, for a repeated work cycle, the operator may wish to store an operator selected height and operator selected orientation corresponding to ground and level. Thus, during the repeated work cycle, the operator can request the control system 83 return the implement assembly 24 to the ground and level position, such as by actuating a button, lever, or device, without having to manually manipulate the lift and tilt adjustment controllers 20 and 22 to return the implement assembly 24 to the repeated position of the work cycle.

The method and system described herein for calculating and displaying work tool orientation and work tool height may be used to further assist the operator in performing certain work operations. According to a specific example, when utilizing forks 32, an operator may perform a work cycle consisting of loading a material, such as a palletized material, from a truck bed and unloading the material to the ground. As such, the operator may have stored an operator selected orientation and height corresponding to level and ground for loading the palletized material. Thus, the operator may use these stored settings when manipulating the implement assembly 24 to perform the work operation.

However, according to a specific example, the operator may have difficulty maintaining a level orientation of the forks 32 when positioning the forks 32 to lift and unload the palletized material from the truck bed. The control system 83 described herein, including the work tool positioning display algorithm stored on and executed by the electronic controller 86, may display work tool positioning information on the operator display 106 that may assist the operator in performing the work operation. In particular, the work tool positioning information this is displayed may supplement the line of sight of the operator to assist the operator in more precisely positioning the work tool 30 during the work operation. For example, it may be challenging for an operator to position the forks 32 at a relatively level orientation, or pitch, with respect to the truck bed.

The work tool positioning display algorithm, which may run continuously or at predetermined intervals, stores the operator selected orientation, calculates a current orientation of the work tool 30, as described herein, calculates a deviation of the current orientation of the work tool 30 from the operator selected orientation, and displays a visual representation of the deviation, such as the visual representations of FIGS. 3 and 4, on the operator display 106. The operator may then use the visual representation of the deviation to adjust the position of the work tool 30, using lift and tilt adjustment controllers 20 and 22, to correspond to the operator selected orientation.

The method and system for calculating and displaying work tool orientation, as described herein, provides a visual representation of the deviation of the current work tool orientation from the operator selected orientation on an operator display, which may be located on the machine or at a location remote from the machine. This information may assist operators in more efficiently and accurately performing work operations, including, for example, manual, remote control, autonomous, and semi-autonomous operations. For machines already configured to electronically identify and store operator selected orientations, the work tool positioning display algorithm may provide an efficient means for conveying useful information to the operator, without requiring additional hardware. Specifically, for machines, such as hydraulic or electro-hydraulic machines, equipped to utilize operator selected orientations, the algorithm described herein may be provided as a retrofit by modifying software on one or more electronic controllers.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A machine, comprising:

a frame;

a plurality of ground engaging elements supported on the frame;

a work tool pivotably attached to the frame using a lift arm assembly and a tilt linkage;

at least one device for measuring a quantity associated with at least one of the lift arm assembly, the tilt linkage, and the work tool; and an electronic controller in communication with an operator display and the at least one device, wherein the electronic controller is configured to store an operator selected orientation of the work tool, calculate a current orientation of the work tool based at least in part on the quantity, calculate a deviation of the current orientation of the work tool from the operator selected orientation, and display a visual representation of the deviation of the current orientation of the work tool on the operator display.

2. The machine of claim 1, further including a first sensor configured to detect an angular orientation of the lift arm assembly and a second sensor configured to detect an angular orientation of the tilt linkage, wherein the current orientation of the work tool is based on the angular orientation of the lift arm assembly and the angular orientation of the tilt linkage.

3. The machine of claim 2, wherein the current orientation corresponds to a current angular displacement of the work tool relative to a reference plane.

4. The machine of claim 3, wherein the first sensor is configured to detect an angular displacement of a lift arm of the lift arm assembly relative to the reference plane, and the second sensor is configured to detect an angular displacement of a first link member of the tilt linkage relative to the lift arm, wherein the angular displacement of the first link member is correlated to an angular displacement of the work tool relative to the lift arm.

5. The machine of claim 4, wherein the operator selected orientation corresponds to an operator selected angular displacement of the work tool relative to the reference plane.

6. The machine of claim 5, wherein the electronic controller is further configured to store an operator selected height, calculate a current height of the work tool based on the angular orientation of the lift arm assembly, calculate a height deviation of the current height from the operator selected height, and display a visual representation of the height deviation on the operator display.

7. The machine of claim 5, wherein the electronic controller is further configured to store a first operator selected height and a second operator selected height, calculate a current height of the work tool based on the angular orientation of the lift arm assembly, and display a visual representation of the current height relative to the first operator selected height and the second operator selected height on the operator display.

8. The machine of claim 2, further including a lift adjustment controller and a tilt adjustment controller positioned within the operator control station and in communication with the electronic controller, wherein the operator selected orientation is based on operator selected positions of the lift adjustment controller and the tilt adjustment controller.

9. The machine of claim 8, further including a hydraulic lift cylinder positioned to adjust the angular orientation of the lift arm assembly and a hydraulic tilt cylinder positioned to adjust the angular orientation of the tilt linkage, wherein the electronic controller is further configured to send a lift control signal to the hydraulic lift cylinder based on the operator selected position of the lift adjustment controller and send a tilt control signal to the hydraulic tilt cylinder based on the operator selected position of the tilt adjustment controller.

10. The machine of claim 2, wherein the electronic controller is further configured to store a default orientation of the work tool and calculate the deviation of the current orientation from the default orientation.

11. A method of operating a machine, the machine including a frame, a plurality of ground engaging elements supported on the frame, a work tool pivotably attached to the frame using a lift arm assembly and a tilt linkage, at least one device for measuring a quantity associated with at least one of the lift arm assembly, the tilt linkage, and the work tool, and an electronic controller in communication with an operator display and the at least one device, the method comprising:

measuring a quantity associated with at least one of the lift arm assembly, the tilt linkage, and the work tool using the at least one device;

storing an operator selected orientation of the work tool on the electronic controller;

calculating a current orientation of the work tool based at least in part on the quantity using the electronic controller; calculating a deviation of the current orientation of the work tool from the operator selected orientation using the electronic controller; and displaying a visual representation of the deviation of the current orientation of the work tool on the operator display.

12. The method of claim 11, further including actuating a lift adjustment controller and a tilt adjustment controller, and storing the operator selected orientation based on actuated positions of the lift adjustment controller and the tilt adjustment controller.

13. The method of claim 12, further including:

adjusting an angular orientation of the lift arm assembly using a hydraulic lift cylinder based on the actuated position of the lift adjustment controller; and adjusting an angular orientation of the tilt linkage using a hydraulic tilt cylinder based on the actuated position of the tilt adjustment cylinder.

14. The method of claim 13, further including adjusting the current orientation using at least one of the lift adjustment controller and the tilt adjustment controller based on the visual representation.

15. The method of claim 11, further including storing an operator selected height on the electronic controller, calculating a current height of the work tool based at least in part on the quantity using the electronic controller, calculating a height deviation of the current height from the operator selected height using the electronic controller, and displaying a visual representation of the height deviation on the operator display.

16. The method of claim 11, further including storing a first operator selected height and a second operator selected height on the electronic controller, calculating a current height of the work tool based at least in part on the quantity using the electronic controller, and displaying a visual representation of the current height relative to the first operator selected height and the second operator selected height on the operator display.

17. A control system for a machine, the machine including a frame, a plurality of ground engaging elements supported on the frame, a work tool pivotably attached to the flame using a lift arm assembly and a tilt linkage, and an electronic controller in communication with an operator display and the at least one device, the control system comprising:

an electronic controller including a memory having a work tool positioning display algorithm and an operator selected orientation stored thereon, wherein the electronic controller includes a processor configured to execute the work tool positioning display algorithm;

at least one device for measuring a quantity associated with at least one of the lift arm assembly, the tilt linkage, and the work tool; and wherein the work tool positioning display algorithm is configured to receive a device signal corresponding to the quantity measured by the at least one device, wherein the work tool positioning display algorithm is further configured to calculate a current orientation of the work tool based at least in part on the quantity, calculate a deviation of the current orientation of the work tool from the operator selected orientation, and send a first display signal corresponding to the deviation of the current orientation of the work tool to an operator display.

18. The control system of claim 17, wherein the work tool positioning display algorithm is configured to receive a first angular orientation signal corresponding to an angular orientation of a lift arm assembly and a second angular orientation signal corresponding to an angular orientation of a tilt linkage, wherein the work tool positioning display algorithm is further configured to calculate the current orientation of the work tool based on the angular orientation of the lift arm assembly and the angular orientation of the tilt linkage.

19. The control system of claim 18, wherein the memory also has a default orientation stored thereon, and the work tool positioning display algorithm is further configured to calculate the deviation of the current orientation from the default orientation.

20. The control system of claim 18, wherein the memory also has a first operator selected height and a second operator selected height stored thereon, and the work tool positioning display algorithm is further configured to calculate a current height of the work tool based on the angular orientation of the lift arm assembly, and send a second display signal corresponding to the current height relative to the first operator selected height and the second operator selected height to the operator display.

* * * * *